US005556437A

United States Patent [19]

Lee et al.

[11] Patent Number: 5,556,437

[45] Date of Patent: Sep. 17, 1996

[54] COATED ABRASIVE HAVING AN OVERCOATING OF AN EPOXY RESIN COATABLE FROM WATER

[75] Inventors: Chong S. Lee, Woodbury; Scott J. Buchanan, Minneapolis, both of Minn.

[73] Assignee: Minnesota Mining and Manufacturing Company, St. Paul, Minn.

[21] Appl. No.: 515,748

[22] Filed: Aug. 16, 1995

Related U.S. Application Data

[63] Continuation of Ser. No. 610,701, Nov. 14, 1990, abandoned.

[51] Int. Cl.[6] ..... B24D 3/34

[52] U.S. Cl. ..... 51/298; 51/295

[58] Field of Search ..... 51/298, 295, 293; 427/203, 205, 386, 407.1, 410; 428/141, 144, 147, 195, 201, 206

[56] References Cited

U.S. PATENT DOCUMENTS

| | | | |
|---|---|---|---|
| 3,489,695 | 1/1970 | Green | 260/2 |
| 3,615,303 | 10/1971 | Singer et al. | 51/295 |
| 3,998,771 | 12/1976 | Feneis, Jr. et al. | 523/442 |
| 4,396,657 | 8/1983 | Ibrahim | 428/36 |
| 4,602,051 | 7/1986 | Nabata et al. | 523/137 |
| 4,652,274 | 3/1987 | Boettcher et al. | 51/298 |
| 4,751,138 | 6/1988 | Tumey et al. | 428/328 |
| 4,927,431 | 5/1990 | Buchanan et al. | 51/298 |
| 4,933,744 | 6/1990 | Segawa et al. | 357/72 |
| 5,368,618 | 11/1994 | Masmar et al. | 51/295 |

FOREIGN PATENT DOCUMENTS

| | | | |
|---|---|---|---|
| 0284064 | 9/1988 | European Pat. Off. . | |
| 0398580 | 11/1990 | European Pat. Off. . | |
| 2307024 | 11/1976 | France . | |
| 2657881 | 6/1978 | Germany . | |
| 154824 | 4/1982 | Germany | C08G 59/18 |
| 3137480 | 4/1982 | Germany | 357/72 |
| 3308373 | 9/1984 | Germany | B41M 1/12 |
| 56-127625 | 10/1981 | Japan | C08G 59/50 |
| 57-024553 | 2/1982 | Japan | C08G 59/42 |
| 57-049647 | 3/1982 | Japan | C08K 3/34 |
| 57-059365 | 4/1982 | Japan | C08G 59/62 |
| 59-055739 | 3/1984 | Japan | B32B 15/12 |
| 59-147068 | 8/1984 | Japan | C08G 59/20 |
| 60-055053 | 3/1985 | Japan | 523/137 |

OTHER PUBLICATIONS

"WaterborneEpoxies For High Performance Nonwovens", K. L. Powell, Celanese Specialty Resins (no date).

*Primary Examiner*—Deborah Jones

*Attorney, Agent, or Firm*—Gary L. Griswold; Walter N. Kirn; Doreen S. L. Gwin

[57] ABSTRACT

A coated abrasive product having a coating comprising a composition formed from an epoxy resin that is capable of being coated from water, a curing agent, and a grinding aid dispersed in the epoxy resin. It is preferred that the coat containing the epoxy resin and the grinding aid be the outermost coat of the coated abrasive product, e.g. the size coat or supersize coat, in order to position the grinding aid in direct contact with the workpiece being abraded.

17 Claims, 1 Drawing Sheet

COATED ABRASIVE HAVING AN OVERCOATING OF AN EPOXY RESIN COATABLE FROM WATER

This is a application Ser. No. 07/610,701 filed Nov. 14, 1990, now abandoned.

FIELD OF THE INVENTION

This invention relates to a coated abrasive having an overcoating, in particular an overcoating formed from an epoxy resin.

BACKGROUND OF THE INVENTION

Coated abrasives comprise a backing having abrasive grains bonded thereto by one or more binders. These binders typically comprise a glutinous or resinous adhesive, and may optionally contain one or more additives. Examples of resinous adhesives include epoxy resins, phenolic resins, urethane resins, acrylate resins, and aminoplast resins. Examples of additives include fillers, grinding aids, wetting agents, dispersing agents, pigments, coupling agents, and dyes.

In some applications, a grinding aid is included in the binder to improve the abrading characteristics of the coated abrasive. It is believed that the grinding aid has a significant effect on the chemical and physical processes of abrading, thereby providing improved performance. For example, Minnesota Mining and Manufacturing Company of St. Paul, Minn. has manufactured Regalite Polycut coated abrasives which contain an overcoating of an epoxy resin with a potassium tetrafluoroborate grinding aid dispersed in the epoxy resin.

The binders previously referred to are typically applied by coating from an organic solvent. There are several advantages in coating a resinous binder from an organic solvent, rather than from water. The lower surface tension of organic solvents provides better wetting and better adhesion, lower viscosities, and better dispersions of the additives.

In recent years, however, there has been a need to coat these resins exclusively from water on account of increasingly stringent pollution legislation. Accordingly, it is desired to provide a coated abrasive product having an overcoating containing an epoxy resin and a grinding aid, wherein the epoxy resin can be coated from water.

U.S. Pat. No. 4,396,657 discloses a saturant for impregnating the multifilament yarns of a stitchbonded coated abrasive backing comprising an epoxy resin, a dicyandiamide, blocked isocyanates, and/or imidazole curing agents. The epoxy resin is capable of being coated from water.

U.S. Pat. No. 3,615,303 discloses a treatment for the backing of a coated abrasive. The treatment, referred to as an intermediate layer, comprises an epoxide resin mixture based on (a) 4,4'-dihydroxydiphenyl-2,2-propane (Bisphenol A), (b) an epoxide resin based on Bisphenol A internally plasticized by a reaction with castor oil, (c) carbamic acid alkyl esters, and (d) a curing agent. This epoxide resin is capable of being coated from water.

SUMMARY OF THE INVENTION

This invention provides a coated abrasive product having an overcoating comprising a composition formed from an epoxy resin that is capable of being coated from water, a curing agent, and a grinding aid dispersed in the epoxy resin. In one embodiment, the coated abrasive product comprises:

a. a backing;

b. a make coat overlying the backing;

c. a plurality of abrasive grains supported on and adherently bonded to at least one major surface of the backing by the make coat; and d. a size coat overlying the abrasive grains and the make coat, wherein the size coat comprises a composition formed from an epoxy resin capable of being coated from water, a curing agent, a grinding aid dispersed in the epoxy resin, and an emulsifier for the epoxy resin.

In another embodiment, the coated abrasive comprises:

a. a backing;

b. a make coat overlying the backing;

c. a plurality of abrasive grains supported on and adherently bonded to at least one major surface of the backing by the make coat;

d. a size coat overlying the abrasive grains and the make coat; and e. a supersize coat overlying the size coat, wherein the supersize coat is formed from a composition comprising an epoxy resin capable of being coated from water, a curing agent, a grinding aid dispersed in the epoxy resin, and an emulsifier for the epoxy resin.

The purpose of the curing agent is to initiate polymerization of the epoxy resin, which is the resinous adhesive in the binder. The purpose of the grinding aid is to improve the abrading characteristics of the coated abrasive. Examples of typical grinding aids include potassium tetrafluoroborate and cryolite. In some cases, it may be beneficial to incorporate a dispersing agent into the compositions containing the epoxy resin coatable from water to reduce the viscosity of these compositions prior to application. The weight ratio of the epoxy resin to the grinding aid ranges from about 10 to 85 parts epoxy resin to about 15 to 85 parts grinding aid.

It is preferred that the coat containing the epoxy resin and the grinding aid be the outermost coat of the coated abrasive product in order to position the grinding aid in direct contact with the workpiece being abraded.

DETAILED DESCRIPTION

As used herein, the term "epoxy resin" refers to epoxy resins capable of being coated from water unless indicated otherwise.

Figure 1:
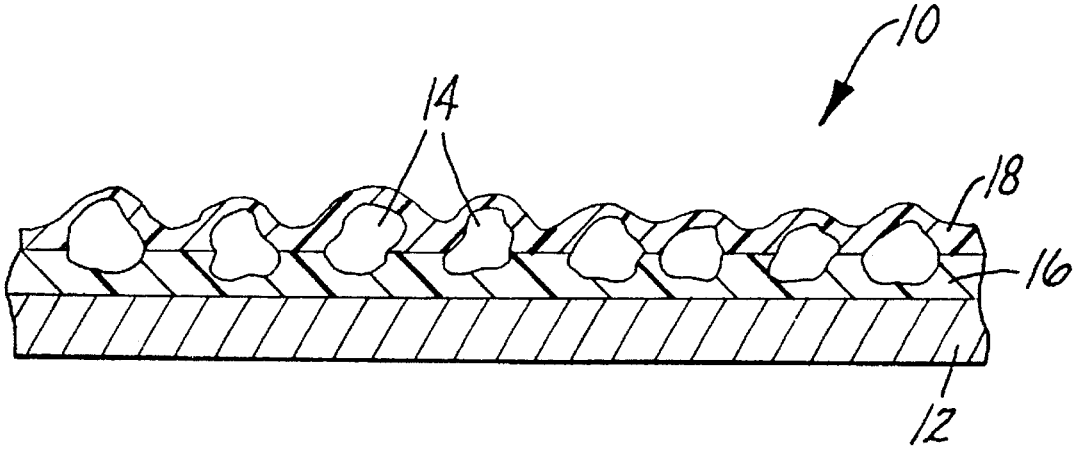
FIG. 1 is a side view of a coated abrasive made according to the present invention.

In the embodiment shown in FIG. 1, coated abrasive 10 comprises a backing 12 and a plurality of abrasive grains 14 supported by and adherently bonded to backing 12 by means of a binder 16, hereafter referred to as the make coat. Overlying abrasive grains 14 and make coat 16 is a binder 18, hereafter referred to as the size coat. Size coat 18 further secures abrasive grains 14 to backing 12. The size coat is prepared from a composition comprising an epoxy resin, an emulsifier for the epoxy resin, a curing agent, a grinding aid, and water. In this particular embodiment, the size coat is the outermost coating of the coated abrasive, and it can directly contact the workpiece being abraded.

Figure 2:
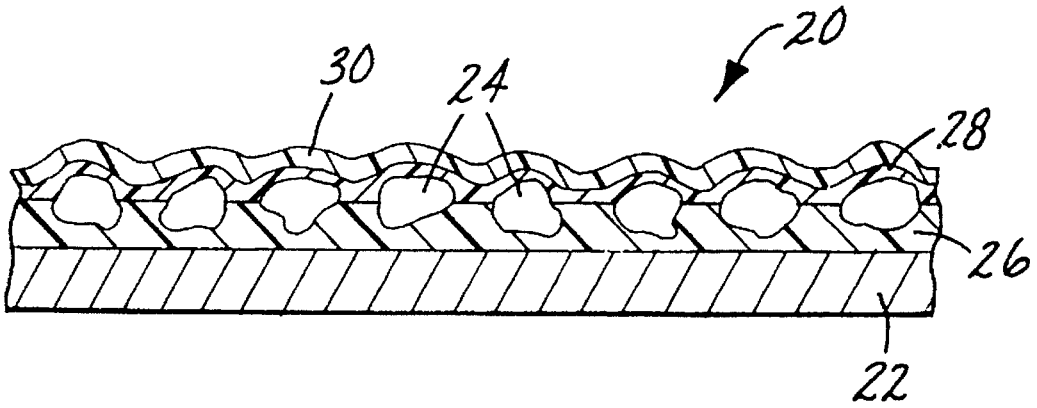
FIG. 2 is a side view of a coated abrasive made according to the present invention.

In the embodiment shown in FIG. 2, coated abrasive 20 comprises a backing 22 and a plurality of abrasive grains 24 supported by and adherently bonded to backing 22 by means of a binder 26, hereafter referred to as the make coat. Overlying the abrasive grains 24 and make coat 26 is a binder 28, hereinafter referred to as the size coat. Coated abrasive 20 further comprises supersize coat 30 overlying size coat 28. Supersize coat 30 is formed from a composition comprising an epoxy resin, an emulsifier for the epoxy resin, a curing agent, a grinding aid, and water. In this particular embodiment, the supersize coat is the outermost coating of the coated abrasive, and it can directly contact the workpiece being abraded. It is also acceptable for both size coat 28 and supersize coat 30 to be formed from a composition comprising an epoxy resin, an emulsifier for the epoxy resin, a curing agent, a grinding aid, and water.

Backings 12 and 22 are preferably selected from materials that can be formed into sheets, such as paper, cloth, polymers, nonwoven materials, vulcanized fibre, combinations thereof and treated versions thereof.

Abrasive grains 14 and 24 are preferably selected from such abrasive materials as silicon carbide, fused aluminum oxide, heat-treated aluminum oxide, garnet, alumina zirconia, ceramic aluminum oxide, diamond, cubic boron nitride, and combinations thereof.

Make coats 16 and 26 and size coat 28 are typically formed from a glutinous or resinous adhesive, and they may also contain other additives. Examples of resinous adhesives suitable for preparing make coats 16 and 26 and size coat 28 include phenolic resins, urea formaldehyde resins, epoxy resins coatable from water, epoxy resins not coatable from water, urethane resins, acrylate resins, aminoplast resins, and mixtures thereof. Additives suitable for make coats 16 and 26 and size coat 28 include wetting agents, grinding aids, fillers, coupling agents, dyes, pigments, and combinations thereof.

Size coat 18 and supersize coat 30 must be prepared from a composition comprising an epoxy resin coatable from water, an emulsifier for the epoxy resin, a curing agent, a grinding aid, and water.

An epoxy resin contains an oxirane ring, i.e.,

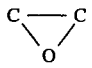

The epoxy resin is polymerized or cured by means of a ring opening mechanism. Epoxy resins suitable for this invention must be coatable from water. Epoxy resins suitable for this invention include both monomeric epoxy compounds and polymeric epoxy compounds. The epoxy resins may vary greatly in the nature of their backbones and their substituent groups; for example, their backbones can be aliphatic, cycloaliphatic, or aromatic. A representative example of an aliphatic epoxy resin is diglycidyl ether of a polyoxyalkylene glycol. Representative examples of cycloaliphatic epoxy resins include epoxycyclohexanecarboxylates, e.g., 3,4-epoxy-2-methylcyclohexylmethyl 3,4-epoxycyclohexanecarboxylate, and 3,4-epoxy-2-methylcyclohexylmethyl 3,4-epoxy-2-methylcyclohexanecarboxylate. Representative examples of aromatic epoxy resins include 3,3-bis[4-(2,3-epoxypropoxy)-phenyl]propane (diglycidyl ether of bisphenol A), N,N,N,N'-tetraglycidyl-4,4'-diaminodiphenylmethane, and triglycidyl-p-aminophenol. The backbone of the epoxy resin can be modified with organic substituents, such as, for example, a urethane epoxy resin. The preferred epoxy resin for this invention is a diglycidyl ether of bisphenol A.

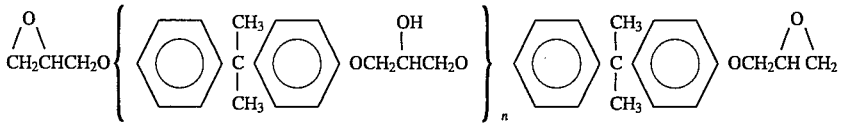

The value of n can range from 0 to 10, but it preferably ranges from 1 to 4. As the value of n increases, the viscosity of the resin also increases. If the viscosity of the resin is too high, it will be difficult to apply as a coating. The epoxide equivalent weight can range from 150 to 700. The pH of the epoxy resin, by itself, will typically be about 7. Examples of commercially available epoxy resins suitable for this invention include the CMD series epoxy resins from Hi-Tek Polymers, Jeffersontown, Ky.

In order to form the coatable composition for preparing size coat 18 and supersize coat 30, the epoxy resin is dispersed in water with the aid of an emulsifier to form a dispersion, hereafter referred to as "epoxy dispersion". The epoxy dispersion will contain from 30 to 90% solids, preferably about 45% to about 75% solids. Emulsifiers that are suitable for preparing the epoxy dispersion include cationic, anionic, and nonionic emulsifiers. Representative examples of these emulsifiers include sodium dioctyl sulfosuccinate, alcohol ethoxylates, and alcohol alkoxylates. A curing agent can then be added to the epoxy dispersion. The purpose of the curing agent is to initiate the polymerization of the epoxy resin after the composition has been coated so that a thermosetting, chemical resistant polymer will be formed. Typically, the epoxy dispersion contains from about 0.01 to about 30% by weight curing agent, preferably 1 to 5% by weight curing agent, based upon the weight of the epoxy resin. Representative examples of curing agents suitable for the epoxy resins of this invention include amines, such as polyamidoamines and tertiary amines, amides such as dicyandiamide, mercaptans, and imidazoles, such as 2-methyl imidazole, 2-phenyl imidazole, and 2-ethyl-4-methylimidazole. The preferred curing agent is 2-ethyl-4-methylimidazole, commercially available from Air Products Company under the trade designation EMI-24. It is also preferred that the curing agent be dispersed in water prior to being added to the epoxy dispersion. Another useful curing agent for the epoxy resin is a urea-formaldehyde resin. Examples of commercially available urea-formaldehyde resins include "Durite AL 8401" and "Durite AL 8405" resins, available from the Borden Chemical Co. The weight ratio of epoxy resin to urea-formaldehyde resin typically ranges from 40 to 80 parts epoxy resin to 20 to 60 parts urea-formaldehyde resin.

In addition to the epoxy resin, the emulsifier, the curing agent, and water, the epoxy dispersion must also contain a grinding aid. As used herein, "grinding aids" are particulate materials, the addition of which to a coated abrasive product enhances the abrading performance of the coated abrasive product. It is believed that the grinding aid exercises a significant effect on the chemical and physical processes encountered during abrading, thereby providing improved performance. In particular, it is believed that the grinding aid will carry out one or more of the following:

(1) decrease friction between the abrasive grains and the workpiece being abraded, (2) prevent abrasive grains from "capping", i.e., prevent metal particles from becoming welded to the tops of the abrasive grains, or (3) decrease interface temperature between the abrasive grains and the workpiece. Furthermore, the addition of grinding aids typically increases the useful life of the coated abrasive.

Representative examples of classes of grinding aids suitable for this invention include waxes, organic halide compounds, halide salts, metals, and alloys of metals. Organic halide compounds typically break down during abrading and release a halogen acid or a gaseous halide compound. Examples of organic halides include chlorinated waxes, such as tetrachloronaphthalene, pentachloronaphthalene; and polyvinyl chloride. Chlorinated waxes can also be considered to be waxes. Examples of halide salts include sodium chloride (NaCl), potassium chloride (KCl), potassium fluoroborate ($KBF_4$), ammonium cryolite ($(NH_4)_3AlF_6$, cryolite ($Na_3AlF_6$), and magnesium chloride ($MgCl_2$). Examples of metals include tin, lead, bismuth, cobalt, antimony, cadmium, iron, and titanium. Other grinding aids include sulfur and organic sulfur compounds, graphite, and metallic sulfides. Combinations of grinding aids can be used, and in some instances may produce a synergistic effect. The preferred grinding aid for stainless steel is potassium tetrafluoroborate. The preferred grinding aid for mild steel is cryolite. The ratio of epoxy resin to grinding aid preferably ranges from about 10 to about 85, preferably about 15 to about 60, parts by weight epoxy resin to about 15 to about 85, preferably about 40 to about 85, parts by weight grinding aid.

In some instances, it is preferred to add a dispersing agent to the epoxy dispersion. For example, if potassium tetrafluoroborate is used as a grinding aid, it is preferred to add a dispersing agent to the epoxy dispersion to lower its viscosity. However, if cryolite is used as a grinding aid, it is not always necessary to add a dispersing agent to the epoxy dispersion. Representative examples of commercially available dispersing agents suitable for this invention include fluorosurfactants having the trademarks of "Fluorad", available from Minnesota Mining and Manufacturing Company, St. Paul, Minn., and "Aerosol OT", available from Rohm & Haas Company. Typically, the concentration of the dispersing agent is less than 2%, based on the weight of the epoxy resin.

In general, the viscosity of the composition containing epoxy resin, emulsifier, curing agent, grinding aid, and water should be less than 10,000 centipoises, preferably less than 5,000 centipoises. If the viscosity is greater than 20,000 centipoises, it is very difficult to apply the composition over and between the abrasive grains.

Other types of resins can also be included in the epoxy dispersion. For example phenolic resins, which can co-react with the epoxy resin, can be included. Additionally, urethanes and rubber compounds can be added to the dispersion in order to improve the toughness of the cured epoxy resin.

Other additives, such as dyes, defoamers, pigments, fillers, and coupling agents, can be used in the composition for preparing the size coat or supersize coat of this invention. Depending upon the particular grinding aid employed, it may be necessary to utilize a defoamer to remove unwanted air bubbles.

It should be noted that make coats 16 and 26 and size coat 28 can also be prepared from compositions comprising an epoxy resin coatable from water, an emulsifier for the epoxy resin, a curing agent, a grinding aid, and water.

In the preferred embodiment of this invention, the make coat of the coated abrasive product utilizes conventional resole phenolic resin containing calcium carbonate as a filler, and the size coat of the coated abrasive product utilizes a conventional resole phenolic resin containing cryolite as a grinding aid. The coated abrasive product utilizes a supersize coat made from a composition containing a diglycidyl ether of bisphenol A epoxy resin, nonionic emulsifier, water, an imidazole curing agent, potassium tetrafluoroborate grinding aid, and "Aerosol OT" dispersing agent. It is preferred that the grinding aid be in the outermost coat of the coated abrasive so that it can be in direct contact with the workpiece being abraded.

Once the epoxy dispersion has been applied to the coated abrasive product, it can be heated to bring about polymerization of the epoxy resin. Heating is typically conducted for a period of from about 10 to about 250 minutes, preferably from about 20 to about 50 minutes, at temperatures from about 80° to about 130° C., preferably from about 105° to about 115° C.

Surprisingly, it has been found that the abrading performance of a coated abrasive containing an epoxy resin of this invention is significantly improved over that of a coated abrasive containing an epoxy resin coated from an organic solvent, with everything else being equal. Furthermore, it has been found that the performance of the coated abrasive containing the epoxy resin of this invention does not decrease over time as rapidly as does that of a coated abrasive containing an epoxy resin coated from an organic solvent.

The advantages of utilizing the epoxy resin of this invention rather than epoxy resins coated from an organic solvent include reduction of pollution, greater ease of cleaning from the coating station, and greater ease of roll coating onto the surface of the coated abrasive.

The following non-limiting examples will further illustrate the invention. All ratios are based upon weight unless indicated otherwise. The following material designations will be used.

Epoxy Resins

BPAW: A composition containing a diglycidyl ether of bisphenol A epoxy resin coatable from water containing approximately 60% solids and 40% water. This composition, which had the designation CMD 35201, was purchased from Hi-Tek Polymers, Jeffersontown, Ky. This composition also contained a nonionic emulsifier.

BPAS: A composition containing a diglycidyl ether of bisphenol A epoxy resin coatable from an organic solvent. This composition, which had the trademark EPON 828, was purchased from the Shell Chemical Company, Houston, Tex.

Curing Agents

EMI: Aqueous solution (25% solids) of 2-ethyl-4-methyl imidazole. This curing agent, which had the designation EMI-24, was commercially available from Air Products, Allentown, Pa.

PA: A polyamide curing agent, having the trade designation "Versamid 125", commercially available from Henkel Corporation DCA: A dicyandiamide curing agent solution, consisting of 12% dicyandiamide and 88% water.

Grinding Aid $KBF_4$: 98% pure micropulverized potassium tetrafluoroborate, in which 95% by weight passes through a 325 mesh screen and a 100% by weight passes through a 200 mesh screen Dispersing Agent "Aerosol OT": A dispersing agent (sodium dioctyl sulfosuccinate ), commercially available from Rohm and Haas Company.

Solvent

"WC 100": An organic solvent, having the trade designation "Aromatic 100", commercially available from Worum Chemical Co., St. Paul, Minn.

EXAMPLES 1 THROUGH 6 AND COMPARATIVE EXAMPLES A THROUGH C

These examples compare the abrading characteristics of coated abrasive products of this invention and coated abrasive products containing epoxy resins coated from an organic solvent. The formulations for each epoxy resin composition are listed in Table I. These formulations were used to make supersize coats for the coated abrasive products. The coated abrasive product of Comparative Example C did not contain a supersize coat.

In the coated abrasive product of each example, the backing was a polyester cloth with a four over one weave containing a phenolic/latex saturant, backsize coat, and presize coat. The make coat contained 48% by weight resole phenolic resin and 52% by weight calcium carbonate as a filler. The make coat (83% solids) was applied to the backing at a wet weight of approximately 190 g/m$^2$. Immediately thereafter, fused alumina abrasive grain (grade 80) was drop coated onto the make coat at a weight of about 400 g/m$^2$. Then ceramic aluminum oxide abrasive grain (grade 80) was electrostatically coated onto the make coat at a weight of 460 g/m$^2$. The resulting article was cured for 15 minutes at 79° C. and then for 60 minutes at 96° C. Next, a size coat containing resole phenolic resin (32% by weight), iron oxide (2% by weight), and cryolite (66% by weight) was applied over the abrasive grains at a weight of about 250 g/m$^2$. The size coat contained approximately 76% solids. The resulting article was cured for 35 minutes at 66° C. and then for 75 minutes at 88° C. The coated abrasive product was finally cured for 10 hours at 100° C. Next, a supersize coat was applied over the size coat and then cured for 30 minutes at 100° C. The formulation of the supersize coat of the coated abrasive product in each example is set forth in Table I.

TABLE I

| | Amount (g) | | | | |
|---|---|---|---|---|---|
| | Comparative | | | | |
| Ingredient | A | B | 1 | 2 | 3 |
| BPAS | 15.55 | 15.55 | — | — | — |
| BPAW | — | — | 29.27 | 28.98 | 24.75 |
| PA | 10.41 | 10.41 | — | — | — |
| DCA | — | — | — | 13.34 | — |
| EMI | — | — | 1.44 | 0.69 | 1.21 |
| $KBF_4$ | 70 | — | 51.30 | 54.39 | 54.0 |
| Cryolite | — | 70 | — | — | — |
| "WC100" | 100 | 100 | — | — | — |
| Water | — | — | 15.02 | — | 16.98 |
| "Aerosol OT" | — | — | 0.77 | 0.40 | 0.86 |
| Iron oxide | 4 | 4 | 2.20 | 2.20 | 2.20 |

| | Example | | |
|---|---|---|---|
| | 4[1] | 5 | 6[1] |
| BPAS | — | — | — |
| BPAW | 22.79 | 29.27 | 27.43 |
| PA | — | — | — |
| DCA | 12.29 | — | 12.53 |
| EMI | 0.59 | 1.44 | 0.72 |
| $KBF_4$ | 52.97 | — | — |
| Cryolite | — | 51.30 | 51.30 |
| "WC100" | — | — | — |
| Water | 8.36 | 15.02 | 5.00 |
| "Aerosol OT" | 0.84 | 0.77 | 0.77 |
| Iron oxide | 2.16 | 2.20 | 2.20 |

[1]For Examples 4 and 6, the DCA solution contained 10% dicyanimide and 90% water.

The coated abrasive product of each example was then converted into 7.6 cm by 335 cm endless abrasive belts. Two belts from each example were tested on a constant load surface grinder. A pre-weighed, 304 stainless steel workpiece approximately 2.5 cm by 5 cm by 18 cm was mounted in a holder, positioned vertically, with the 2.5 cm by 18 cm face confronting approximately 36 cm diameter 60 Shore A durometer serrated rubber contact wheel with one on one lands over which was entrained the coated abrasive belt. The workpiece was then reciprocated vertically through a 18 cm path at the rate of 20 cycles per minute, while a spring-loaded plunger urged the workpiece against the belt with a load of 6.7 kg as the belt was driven at about 2,050 meters per minute. After one minute of grinding time had elapsed, the workpiece holder assembly was removed and reweighed, the amount of stock removed calculated by subtracting the weight after abrading from the original weight. Then a new, pre-weighed workpiece and holder were mounted on the equipment. The experimental error on this test was ±10%. The test results are set forth in Table II. The initial cut is a measure of the amount of stainless steel removed during the first minute of grinding. The final cut is a measure of the amount of stainless steel removed during the last minute of grinding. The total cut is a measure of the total amount of stainless steel removed throughout the test. The test was deemed ended when the amount of final cut was less than one third the amount of initial cut for more than two minutes.

TABLE II

| | Cut (g) | | | |
|---|---|---|---|---|
| Example no. | Initial | Final | Total | % of control |
| Comparative A | 65.2 | 21.4 | 607.6 | 100 |
| Comparative B | 62.3 | 20.2 | 376.6 | 62 |
| Comparative C | 56.8 | 16.8 | 198.9 | 33 |
| 1 | 58.4 | 20.7 | 840.7 | 138 |
| 2 | 58.3 | 20.3 | 867.8 | 143 |
| 3 | 64.9 | 20.5 | 936.5 | 154 |
| 4 | 63.1 | 19.4 | 921 | 152 |
| 5 | 56.2 | 20.3 | 281.4 | 46 |
| 6 | 56.7 | 18.5 | 310.3 | 51 |

The data in Table II show that the coated abrasive product that contained an epoxy resin coated from water significantly outperformed a coated abrasive product similar thereto, but containing instead an epoxy resin coated from solvent. Moreover, the incremental cut of the coated abrasive products of Examples 1 through 4 was higher than that of the coated abrasive product of Comparative Example A. This result was surprising, because both epoxy resins were diglycidyl ethers of bisphenol A and the water and solvent were completely removed upon curing.

It should noted that the coated abrasive products that contained both epoxy resins that were coated from water and cryolite did not perform as well as coated abrasive products that contained both epoxy resins that were coated from solvent and cryolite. When the supersize coats for Examples 5 and 6 were prepared, it was noted that there was excessive foaming. This foaming can be reduced with the addition of an appropriate anti-foaming agent.

EXAMPLE 7 AND COMPARATIVE EXAMPLE D

Example 7 and Comparative Example D illustrate how a dispersing agent aids in the dispersion of potassium tetrafluoroborate grinding aid.

COMPARATIVE EXAMPLE D

The following materials were mixed together in the amounts indicated.

| Ingredient | Amount (g) |
|---|---|
| BPAW | 4,837 |
| EMI | 259 |
| $KBF_4$ | 4,233 |
| Water | 671 |

EXAMPLE 7

Approximately 200 g of "Aerosol OT" dispersing agent, were added dropwise to the materials in the mixture of Comparative Example D. The viscosity of the resulting mixture was then measured on a Brookfield viscometer with a #3 spindle at 30 rpm and found to be 2,920 centipoises.

EXAMPLES 8–16

These examples illustrate the effect of the weight of the supersize coat, the amount of grinding aid, and the curing temperature of the supersize coat on abrading performance.

Coated abrasive discs were prepared according to the following procedure. A conventional calcium carbonate filled resole phenolic resin was applied to 0.76 mm thick vulcanized fibre backing sheet to form a make coat. Next, grade 50 heat treated aluminum oxide abrasive grains were drop coated onto the make coat. A blend of 30% ceramic aluminum oxide abrasive grains (grade 50) and 70% heat treated aluminum oxide abrasive grains (grade 50) were electrostatically coated onto the make coat. The ceramic aluminum oxide abrasive grains were made according to U.S. Pat. No. 4,881,951. The make coat was then precured for 200 minutes at about 90° C. Next, a conventional cryolite filled resole phenolic resin was applied over the abrasive grains to form a size coat. The size coat was precured for 90 minutes at 88° C. Then the supersize coat was applied over the size coat. Table III sets forth the formulations for preparing the supersize coats, the coating weight of the supersize coats, and curing temperatures for the supersize coats. Formulation I contained 29.57% BPAW, 1.4% EMI, 0.78% "Aerosol OT", 2.29% iron oxide, 55% $KBF_4$, and 10.92% water. Formulation II contained 35.08% BPAW, 1.68% EMI, 0.78% "Aerosol OT", 2.17% iron oxide, 52.4% $KBF_4$, and 7.89% water. Formulation III contained 39.83% BPAW, 1.93% EMI, 0.78% "Aerosol OT", 2.07% iron oxide, 49.75% $KBF_4$, and 5.64% water. After the formulations for preparing the supersize coats were applied, the sheet material was cured for 30 minutes at the temperatures set forth in Table III and then final cured for 24 hours at 99° C. After the curing steps, the sheet material was flexed and rehumidified. After the curing steps, Formulation I contained 76% grinding aid, Formulation II contained 72% grinding aid, and Formulation III contained 68% grinding aid.

The sheet material for each example was then converted into 17.8 cm diameter discs with a 2.2 cm diameter center hole. The discs were mounted on a beveled aluminum back up pad and used to grind the face of a 2.5 cm by 18 cm 304 stainless steel workpiece. The discs were driven at 5,500 rpm while the portion of the disc overlaying the beveled edge of the backup pad contacted the workpiece at 4.54 kg pressure. The wear path of the disc was about 140 $cm^2$. Each disc was used to grind a separate workpiece for one minute each for a total duration of 12 minutes. The initial cut was the amount of stainless steel removed in the first minute, and the final cut was the amount of stainless steel removed in the last minute of abrading. The results are set forth in Table IV.

TABLE III

| Example no. | Formulation | Coating weight ($g/m^2$) | Cure temperature (°C.) |
|---|---|---|---|
| 8 | III | 143 | 98 |
| 9 | III | 143 | 121 |
| 10 | III | 184 | 98 |
| 11 | III | 184 | 121 |
| 12 | I | 143 | 98 |
| 13 | I | 143 | 121 |
| 14 | I | 184 | 98 |
| 15 | I | 184 | 121 |
| 16 | II | 163 | 110 |

TABLE IV

| Example no. | Initial cut (g) | Final cut (g) | Total cut (g) |
|---|---|---|---|
| 8 | 23.4 | 3.4 | 110.1 |
| 9 | 24.8 | 3.4 | 111.5 |
| 10 | 26.5 | 3.1 | 119.9 |
| 11 | 23.8 | 2.6 | 113.1 |
| 12 | 26.6 | 3.2 | 119.8 |
| 13 | 25.1 | 3.9 | 121.5 |
| 14 | 27.1 | 4.5 | 136.9 |
| 15 | 25.8 | 3.6 | 128.2 |
| 16 | 26.8 | 3.9 | 124.8 |

The data in Table IV show that the high level of grinding aid enhanced the performance of the coated abrasive disc.

EXAMPLES 17, 18, AND COMPARATIVE EXAMPLE E

These examples illustrate the performance of a coated abrasive product containing cryolite as a grinding aid. The supersize coat for Comparative Example E contained an epoxy resin coatable from solvent and a cryolite grinding aid and the supersize coats for Examples 17 and 18 contained an epoxy resin coatable from water and a cryolite grinding aid. The product of Comparative Example E was substantially identical to the coated abrasive product of Comparative Example B. The coated abrasive product of Example 17 was substantially identical to the coated abrasive product of Example 5 and the coated abrasive product of Example 18 was substantially identical to the coated abrasive product of Example 6.

The coated abrasive products of these examples were tested in the same manner as were the coated abrasive products of Examples 1 through 6, except that the workpiece was a 4150 tool steel. The grinding results are set forth in Table V.

TABLE V

| Example | Initial cut (g) | Total cut (g) |
|---|---|---|
| Comparative E | 65.6 | 962 |
| 17 | 58 | 944 |
| 18 | 63 | 959 |

The data in Table V illustrate that the coated abrasive products of Examples 17 and 18 performed substantially the same as did the coated abrasive product of Comparative Example E.

EXAMPLE 9 AND COMPARATIVE EXAMPLE F

These examples illustrate the effectiveness of urea-formaldehyde resin as a curing agent for the epoxy resin. The coated abrasive product of Comparative Example F was made and tested in the same manner as was the coated abrasive product of Comparative Example A. The grinding results are set forth in Table VI. The coated abrasive product of Example 19 was made and tested in the same manner as was the coated abrasive product of Comparative Example F except that a different supersize coat was employed. The supersize coat was prepared by charging into a container 2,225 g of a urea-formaldehyde resin ("Durite Al 8405", Borden Chemical Co.), 2,225 g of epoxy resin (BPAW), 1,555 g of water, 50 g of "Aerosol OT" dispersing agent, and 5 g of X2-5147 dispersing agent (Dow Chemical Co.). The mixture was stirred until homogeneous; then 225 g of iron oxide pigment and 8,325 g of $KBF_4$ grinding aid were added thereto. The resulting mixture was stirred until homogeneous, and was then applied to the surface of the coated abrasive product at a wet coating weight of 184 g/m$^2$. The grinding results are set forth in Table VI. The supersize coat was cured in the same manner as was the supersize coat in Example 1.

TABLE VI

| Example | Initial cut (g) | Final cut (g) | Total cut (g) |
|---|---|---|---|
| Comparative F | 79.7 | 24.6 | 581.2 |
| 19 | 86.1 | 24.6 | 674.4 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A coated abrasive product comprising:

a. a backing;

b. a make coat overlying said backing;

c. a plurality of abrasive grains supported on and adherently bonded to said backing by means of said make coat; and d. a size coat overlying said abrasive grains and said make coat, wherein said size coat is formed from a composition comprising an epoxy resin coatable from water, an emulsifier for said epoxy resin, a curing agent, a grinding aid dispersed in said epoxy resin, and water.

2. A coated abrasive product according to claim 1, wherein said epoxy resin is a diglycidyl ether of bisphenol A.

3. A coated abrasive product according to claim 1, wherein said grinding aid is potassium fluoroborate.

4. A coated abrasive product according to claim 1, wherein said curing agent selected from the group consisting of amines, amides, imidazoles, and urea-formaldehyde.

5. A coated abrasive product according to claim 1, wherein the ratio of said epoxy resin to said grinding aid ranges from about 10 to about 85 parts by weight epoxy resin to about 15 to about 85 parts by weight grinding aid.

6. A coated abrasive product according to claim 1, wherein the ratio of the said epoxy resin to said grinding aid ranges from about 15 to about 60 parts by weight epoxy resin to about 40 to about 85 parts by weight grinding aid.

7. A coated abrasive product according to claim 1, wherein said composition further comprises a dispersing agent.

8. A coated abrasive product comprising:

a. a backing;

b. a make coat overlying said backing;

c. a plurality of abrasive grains supported on and adherently bonded to said backing by means of said make coat;

d. a size coat overlying said abrasive grains; and e. a supersize coat overlying said size coat, wherein said supersize coat is formed from a composition comprising an epoxy resin coatable from water, an emulsifier for said epoxy resin, a curing agent, a grinding aid dispersed in said epoxy resin, and water.

9. A coated abrasive product according to claim 8, wherein said epoxy resin is a diglycidyl ether of bisphenol A.

10. A coated abrasive product according to claim 8, wherein said grinding aid is potassium fluoroborate.

11. A coated abrasive product according to claim 10, wherein said composition further comprises a dispersing agent.

12. A coated abrasive product according to claim 8, wherein said curing agent is selected from the group consisting of amines, amides, imidazoles, and urea-formaldehyde.

13. A coated abrasive product according to claim 8, wherein the ratio of said epoxy resin to said grinding aid ranges from about 10 to about 85 parts by weight epoxy resin to from about 15 to about 85 parts by weight grinding aid.

14. A coated abrasive product according to claim 8, wherein the ratio of said epoxy resin to said grinding aid ranges from about 15 to about 60 parts by weight epoxy resin to from about 40 to about 85 parts by weight grinding aid.

15. A coated abrasive product according to claim 8, wherein said composition further comprises a dispersing agent.

16. Method of preparing a coated abrasive product, the method comprising the steps of:

(1) providing a backing;

(2) applying a make coat over said backing;

(3) applying a plurality of abrasive grains onto said make coat;

(4) at least partially curing said make coat;

(5) applying over said make coat and said abrasive grains, a composition comprising:

(a) an epoxy resin coatable from water, (b) an emulsifier for said epoxy resin, (c) a curing agent, (d) a grinding aid dispersed in said epoxy resin, and
(e) water; and (6) curing.

17. Method of preparing a coated abrasive product, the method comprising the steps of:

(1) providing a backing;

(2) applying a make coat over said backing;

(3) applying a plurality of abrasive grains onto said make coat;

(4) at least partially curing said make coat;

(5) applying a size coat over said make coat and abrasive grains;

(6) at least partially curing said make coat and said size coat;

(7) applying over said make coat, abrasive grains, and size coat, a composition comprising:
(a) an epoxy resin coatable from water,
(b) an emulsifier for said epoxy resin,
(c) a curing agent,
(d) a grinding aid dispersed in said epoxy resin, and
(e) water; and (8) curing.

* * * * *